United States Patent [19]

Smith, Sr. et al.

[11] Patent Number: 4,597,110

[45] Date of Patent: Jul. 1, 1986

[54] UNDERGARMENT

[75] Inventors: James R. Smith, Sr.; Martha J. Smith, both of Memphis, Tenn.

[73] Assignee: Joe W. Johnson, Fulton, Ky.

[21] Appl. No.: 672,997

[22] Filed: Nov. 19, 1984

[51] Int. Cl.[4] ..... A41B 9/04

[52] U.S. Cl. ..... 2/408; 2/406

[58] Field of Search ..... 2/408, DIG. 6, 238; 128/526, 400–407

[56] References Cited

U.S. PATENT DOCUMENTS

| | | | |
|---|---|---|---|
| 3,503,405 | 3/1970 | Porco | 2/408 |
| 3,974,836 | 8/1976 | Carlson | 128/526 |
| 4,145,763 | 3/1979 | Abrams et al. | 2/DIG. 6 |

*Primary Examiner*—Doris L. Troutman

*Attorney, Agent, or Firm*—Harry B. O'Donnell, III

[57] ABSTRACT

A panty-type undergarment comprising a waistband connected to a body segment having front and back panels which terminate at leg openings, with a crotch segment located between the leg openings and a crotch opening situated between the leg openings and separating the crotch segment and the front panel along an edge of each extending generally parallel to the waistband, wherein the front panel adjacent to the crotch opening has first fastener means and the crotch segment adjacent to the crotch opening has second fastener means releasably engageable with the first fastener means so that the wearer can selectively open and close the crotch opening of the undergarment by selectively peeling apart and pressing together the first and second fastener means.

3 Claims, 3 Drawing Figures

UNDERGARMENT

BACKGROUND OF THE INVENTION

The present invention relates to undergarments and particularly to panty-type undergarments. More particularly, the present invention provides a novel panty-type undergarment having a crotch opening between a crotch segment and a front panel wherein the crotch opening extends generally parallel to a waistband of the undergarment and first and second fastener means, such as Velcro-type fastener means, are provided adjacent the crotch opening to facilitate selective opening and closing of the crotch opening by selectively peeling apart and pressing together the first and second fastener means.

The prior art illustrates various types of undergarments with certain crotch opening devices. For example, U.S. Pat. No. 3,974,836 discloses a girdle wherein a "V"-shaped crotch opening is provided and a pair of "V"-shaped closure devices are provided. And, U.S. Pat. No. 3,913,146 further discloses an undergarment having slip and panties wherein a crotch opening and closure arrangement is provided. However, that old arrangement specifically relates to snap-type fasteners, which would not be capable of the peeling opening and press closing provided of the crotch opening as provided by arrangements within the scope of the present invention.

U.S. Pat. No. 3,279,469 describes a foundation garment that, as the one also shown in U.S. Pat. No. 3,974,836, provides closure arrangement having a generally "V"-shaped appearance and, as in the aforenoted U.S. Pat. No. 3,913,146, employs snap fastener means.

U.S. Pat. No. 2,339,341 shows a slip-type undergarment having a crotch closure with double snap fasteners wherein overlapping halves are utilized.

Finally, U.S. Pat. No. 3,023,419 describes a leotard arrangement having a crotch opening and closure utilizing hooks, snaps or zippers at the narrowest point between the leg openings, rather than above the narrowest point.

SUMMARY OF THE INVENTION

The present invention relates to undergarments and, more particularly, to providing a novel panty-type undergarment having a unique and useful crotch opening and closure arrangement.

More specifically, the present invention provides a novel panty-type undergarment having a crotch opening between a crotch segment and a front panel, wherein the crotch opening extends generally parallel to the undergarment waistband and first and second fastener means are provided adjacent to the crotch opening to facilitate selective opening and closing of the same by selectively peeling apart and pressing together the first and second fastener means.

Preferably, the first and second fastener means comprise continuous hook-and-eye type closure elements, for example Velcro-type fastener means, wherein cooperative releasably engageable fastener elements of those fastener means are provided on the edges of crotch segment and front panel that are adjacent to a crotch opening for the undergarment. When the crotch opening is closed, the distal front or upper edge of the crotch segment lies in underlying relation with respect to the distal edge of the front panel member, such that the wearer can simply peel apart the first fastener elements provided on the crotch segment from those provided on the front panel to open the crotch opening and can then simply reclose the crotch opening by pressing the fastener elements provided on the crotch segment against those provided on the front panel of the undergarment.

Stated in more detail, the present invention provides a panty-type undergarment including a waistband connected to a body segment having front and back panels which terminate at leg openings, with a crotch segment located between the leg openings of the undergarment and defining a crotch opening situated between the leg openings and separating the crotch segment and the front panel along an edge of each extending generally parallel to the waistband, wherein the inner surface or the lower distal edge of the front panel adjacent to the crotch opening has first fastener means and the outer surface of the front or upper distal end of the crotch segment has second fastener means cooperative with the first fastener means to be releasably engageable with the first fastener means so that the wearer can open the crotch opening of the panty-type undergarment by simply peeling apart the first and second fastener means and can close the crotch opening by pressing together those same first and second fastener means.

Arrangements within the scope of the present invention will occur to those skilled in the art upon reading the additional disclosure set forth hereinafter, which is directed toward a presently preferred embodiment of the novel undergarment provided within the scope of the present invention and is presented in the drawing included herewith for purpose of example but not by way of limitation.

BRIEF DESCRIPTION OF THE DRAWING

The present invention is illustrated in the accompanying drawings, wherein.

DETAILED DESCRIPTION

Figure 1:
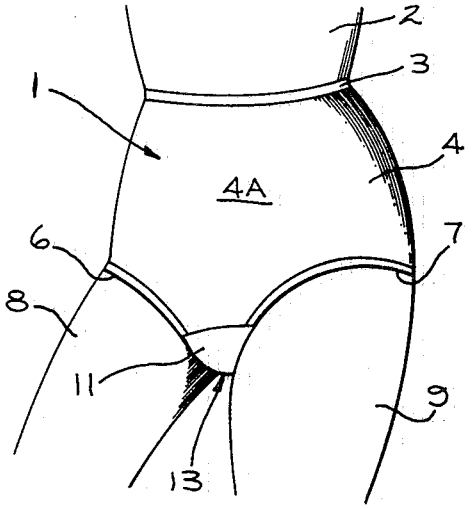
FIG. 1 is a front elevational view illustrating one presently preferred form of the novel undergarment that is provided in accordance with the present invention being worn by a female wearer.

Turning now to the drawing and, more particularly, to FIG. 1 thereof, there is shown a presently preferred form of the novel undergarment 1 that is provided in accordance with the present invention being worn by a female wearer 2. The undergarment 1 comprises a waistband 3, which encircles the waist of the wearer 2 and is attached to a body element 4 having back (now shown) and front 4A panels permanently connected to one another which terminate at leg openings 6 and 7, that are provided to receive the right and left legs 8 and 9 of the wearer 2.

Figure 2:
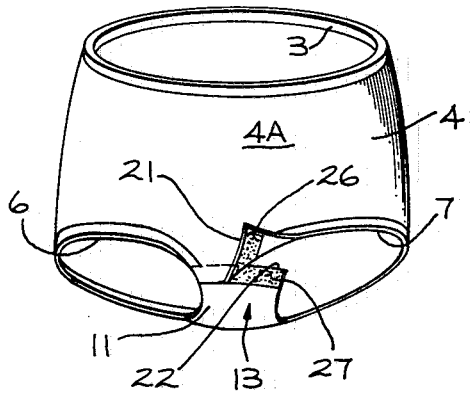
FIG. 2 is a front elevational perspective view of the undergarment shown in FIG. 1, with the crotch opening partially opened.
Figure 3:
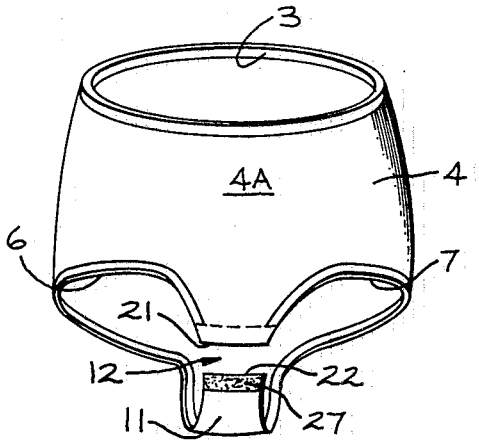
FIG. 3 is a view similar to FIG. 2, but with the crotch opening of the undergarment completely opened.

As further shown in drawing FIGS. 1–3, the undergarment 1 also comprises a crotch segment 11 that extends from the lower central portion of the back panel of the body element 4 so as to be situated between the undergarment leg openings 6 and 7 and terminates along its distal front or upper edge 22 and is separated from a complementary distal lower edge 21 that is provided at the central lower portion of the front panel 4A to provide the undergarment 1 with a crotch opening 12 located some distance above the narrowest portion 13 of that crotch opening 12.

As best illustrated in drawing FIG. 3, the edges 22 and 21 of the crotch segment 11 and front panel 4A of the undergarment 1 extend generally parallel to the waistband 3 and separate the crotch segment 11 from the front panel 4A at a position above the narrowest portion 13 of the crotch segment 11 that extends between the legs 8 and 9 of the wearer 2. As further shown in drawing FIGS. 1 and 2, the edge 22 of the crotch segment 11 extends across a portion of the crotch segment 11 that is wider than and located some distance above the narrowest portion 13 of the crotch segment 11 that extends between the legs 8 and 9 of the wearer 2.

As additionally illustrated in drawing FIGS. 1–3, the novel undergarment 1 of the present invention further comprises first and second fastener means 26 and 27 that are respectively provided on the inner and outer surfaces of the front panel 4A and crotch segment 11 adjacent to their respective distal edges 21 and 22 and the crotch opening 12.

As best illustrated in drawing FIGS. 2 and 3, the fastener means 26 and 27 consist of Velcro or Velcro-type fasteners which are easy to open and close and provide an adjustable fit to the wearer 2 of the novel undergarment 1 that is provided in accordance with the present invention. Velcro is a flexible material capable of multiple adjustments by virtue of hooks and loops locking elements provided on the engageable or fastenable portions. Velcro fastener means consist of a first surface that is composed of nylon "loops" or pile material engageable with another surface which is composed of Velcro nylon "hooks".

In the embodiment of the novel undergarment 1 of the present invention illustrated in the drawings, the hook fastener elements of the first fastener means 26 are provided on the inner surface of the front panel 4A of the body panel 4 adjacent to its aforenoted edge 21, while the "eye" fastener elements of the second fastener means 27 are provided on the outer surface of the crotch segment 11 adjacent to its aforenoted distal front or upper edge 22.

As is apparent, the aforedescribed first and second fastener means 26 and 27 are releasably engageable with one another so that the wearer 2 of the undergarment 1 can selectively open and close the crotch opening 12 of the undergarment 1 by selectively peeling apart (FIG. 3) and pressing together (FIGS. 1 and 2) the first and second fastener means 26 and 27. To open the crotch opening 12, the wearer 2 can readily peel apart the first and second fastener means 26 and 27 to thus separate the respective edges 21 and 22 of the front panel 4A of the body element 4 from the edge 22 of the crotch segment 11 and thus fully open the crotch opening 12. And, when it is desired to close the crotch opening 12, the wearer 2 of the undergarment 1 can do so by pressing together the fastener elements of the first and second fastener means 26 and 27 to thus releasably engage the same together at the degree of "snugness" desired by the wearer 2.

It should be apparent that while there has been described what is currently considered to be presently preferred form of the present invention in accordance with the Patent Statutes, changes may be made in the disclosed undergarment without departing from the true spirit and scope of this invention. It is, therefore, intended that the appended claims shall cover such modifications and applications that may not depart from the true spirit and scope of the present invention.

What is claimed is:

1. An undergarment comprising:

(a) a waistband connected to a body segment having front and back panels permanently connected to one another which terminate at leg openings;

(b) a crotch segment located between said leg openings;

(c) a crotch opening situated between said leg openings and separating said crotch segment and front panel along an edge of each extending generally parallel to said waistband and being located some distance above the narrowest portion of said crotch segment that extends between said leg openings;

(d) first fastener means provided on said front panel adjacent to said crotch opening;

(e) second fastener means provided on said crotch segment adjacent to said crotch opening and being releasably engageable with said first fastener means so that said crotch opening can be selectively opened and closed by selectively peeling apart and pressing together said first and second fastener means, and (f) said edge of said crotch segment extending across a portion of said crotch segment that is wider than and located some distance above the narrowest portion of said crotch segment that extends between said leg portions.

2. The invention of claim 1, wherein said first and second fastener means are flexible hook-and-eye-type fastener means.

3. The invention of claim 2, wherein said first and second fastener means are Velcro fastener means.

* * * * *